US008054287B2

(12) United States Patent
Tai et al.

(10) Patent No.: US 8,054,287 B2
(45) Date of Patent: Nov. 8, 2011

(54) DRIVING APPARATUS, DRIVING METHOD AND LIQUID CRYSTAL DISPLAY USING THE SAME

(75) Inventors: Wen-Chih Tai, Hsinchu County (TW); Kuang-Lang Chen, Taoyuan County (TW); Chia-Lin Liu, Taichung County (TW); Chi-Neng Mo, Taoyuan County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 568 days.

(21) Appl. No.: 12/333,274

(22) Filed: Dec. 11, 2008

(65) Prior Publication Data

US 2010/0039367 A1 Feb. 18, 2010

(30) Foreign Application Priority Data

Aug. 13, 2008 (TW) ..... 97130879 A

(51) Int. Cl.
*G09G 3/36* (2006.01)

(52) U.S. Cl. ..... 345/102; 369/103; 369/204

(58) Field of Classification Search ..... None
See application file for complete search history.

(56) References Cited

U.S. PATENT DOCUMENTS

| | | | | |
|---|---|---|---|---|
| 2006/0028424 | A1 | 2/2006 | Wu et al. | |
| 2007/0176943 | A1 | 8/2007 | Cho | |
| 2008/0273005 | A1 * | 11/2008 | Chen et al. | 345/102 |
| 2010/0141693 | A1 * | 6/2010 | Lee et al. | 345/694 |

FOREIGN PATENT DOCUMENTS

| | | |
|---|---|---|
| TW | 200606492 | 2/2006 |
| TW | 200816128 | 4/2008 |

* cited by examiner

*Primary Examiner* — Muhammad N Edun
(74) *Attorney, Agent, or Firm* — Jianq Chyun IP Office

(57) ABSTRACT

A driving apparatus, a driving method and a liquid crystal display (LCD) using the same are provided, wherein the method includes the following steps of: setting a color display sequence, wherein the color display sequence is RGBG, RGRB or RBGB; alternately reading frame data from a first frame register and a second register according to a frame period having three field periods; and sequentially displaying four color data in a cycle period having four field periods according to the color display sequence and the read frame data. By utilizing the method in the present invention, color loss of a field sequential color display occurred in a lower temperature environment is improved.

12 Claims, 5 Drawing Sheets

DRIVING APPARATUS, DRIVING METHOD AND LIQUID CRYSTAL DISPLAY USING THE SAME

CROSS-REFERENCE TO RELATED APPLICATION

This application claims the priority benefit of Taiwan application serial no. 97130879, filed on Aug. 13, 2008. The entirety of the above-mentioned patent application is hereby incorporated by reference herein and made a part of specification.

BACKGROUND OF THE INVENTION

1. Field of the Invention

The present invention relates to a driving method of a liquid crystal display and more particularly, to a driving apparatus and driving method of a field sequential color liquid crystal display.

2. Description of Related Art

The liquid crystal display (LCD) has advantages such as low power consumption, thinness, light weight, and low driving voltages and thus is widely used in various electronic devices, for example, video recorders and players, notebook computers, desktop displays, mobile phones, and various projection devices. In terms of display devices, the thin film transistor liquid crystal display (TFT-LCD) has advantages such as highly effective space usage, low power consumption, and free of radiation so the TFT-LCD has become the main stream of the display market.

Display quality of an LCD is mainly influenced by reaction speed of liquid crystals. In a low temperature environment, reaction speed of liquid crystals becomes low, resulting in color loss in the display. Furthermore, in the field sequential color LCD (FSC-LCD), the order of switching color light of different colors (or a color display sequence of an RGB field period) may also affect the degree of color loss in addition to the reaction speed of liquid crystals. It can be known from simulation, when reaction speed of liquid crystals is low and the color display sequence of an RGB field period is from red (R) to green (G), from green (G) to blue (B), and from blue (B) to red (R), the degree of color loss is more serious as shown in FIG. 1, which is a chromaticity diagram according to prior art.

FIG. 1 illustrates a chromaticity curve range under different reaction speeds of liquid crystals. When the reaction speed of liquid crystals becomes lower, color saturation of the display becomes lower as well, the color that is originally red turns greenish, and the color that is originally green turns bluish.

SUMMARY OF THE INVENTION

The present invention provides a display method and an LCD using the same, in which the order of switching colors is changed to improve the problem of color loss and the display sequence of backlight is used to improve color vividness of still images and to improve LCD display quality in a low temperature environment.

The present invention provides a driving apparatus which uses a specific order of switching colors to drive an LCD. A color data is inserted in the original RGB color sequence to change the color display sequence and to improve the problem of color loss.

In light of the above, the present invention provides a display method suitable for a driving apparatus and a backlight module of an LCD. The driving apparatus sequentially updates a first frame data stored in a first frame register and a second frame data stored in a second frame register. Each of the frame data includes three color data of R, G and B. The backlight module is divided into a first sub region, a second sub region, and a third sub region according to a scan direction of the driving apparatus. The display method includes the following steps.

A color display sequence is set. The first frame data and the second frame data are alternately read according to a frame period. The frame period includes three field periods. Four color data are sequentially displayed according to the color display sequence and the read first frame data or second frame data in a cycle period. The cycle period includes four field periods. The four color data are respectively displayed during the field periods of the cycle period. The color display sequence is RGBG, RGRB or RBGB.

In one embodiment of the present invention, the step of sequentially displaying the four color data according to the color display sequence and the read first frame data and second frame data further includes the following steps. In a first field period of the cycle period, the displayed color lights in the first sub region, second sub region, and third sub region are sequentially updated according to a first color data corresponding to the first field period. When the first sub region is being updated, the second sub region is inserted with black. When the second sub region is being updated, the third sub region is inserted with black. When the third sub region is being updated, the first sub region is inserted with black.

In one embodiment of the present invention, the step of sequentially displaying the four color data according to the color display sequence and the read first frame data and second frame data further includes the following steps. In a second field period of the cycle period, the displayed color lights in the first sub region, second sub region, and third sub region are sequentially updated according to a second color data corresponding to the second field period. When the first sub region is being updated, the second sub region is inserted with black. When the second sub region is being updated, the third sub region is inserted with black. When the third sub region is being updated, the first sub region is inserted with black.

In one embodiment of the present invention, the second sub region is between the first sub region and the third sub region.

In one embodiment of the present invention, the first color data is R, G, or B.

The present invention further provides an LCD including a liquid crystal panel, a driving apparatus, and a backlight module. The driving apparatus is used to drive the liquid crystal panel and to sequentially update a first frame data stored in a first frame register as well as a second frame data stored in a second frame register. Each frame data includes three color data R, G, and B. The driving apparatus is used to further perform the following steps. A color display sequence is set. The first frame data and the second frame data are alternately read according to a frame period. The frame period includes three field periods. Four color data are sequentially displayed according to the color display sequence and the read first frame data or second frame data in a cycle period. The cycle period includes four field periods. The four color data are displayed respectively during the field periods of the cycle period.

The backlight module provides backlight required by the liquid crystal panel and is divided into a first sub region, a second sub region, and a third sub region according to a scan direction of the driving apparatus. In a first field period of the cycle period, displayed color lights in the first sub region, second sub region, and third sub region are sequentially updated according to a first color data corresponding to the first field period. When the first sub region is being updated, the second sub region is inserted with black. When the second sub region is being updated, the third sub region is inserted with black. When the third sub region is being updated, the first sub region is inserted with black. The color display sequence is RGBG, RGRB or RBGB.

The present invention further provides a driving apparatus used in an LCD. The driving apparatus includes a line buffer, a frame register, and a timing controller. The line buffer is used to temporarily store a plurality of scan line data output from an image processor. The frame register is electrically connected to the line buffer and reads the scan line data through the line buffer to update a frame data stored in the frame register. The frame data includes three color data R, G, and B. The timing controller is electrically connected to the line buffer and the frame register to read the frame data in the frame register and to control the timing of the frame register updating the frame data.

The timing controller is further used to perform the following steps. A color display sequence is set to be RGBG, RGRB or RBGB. In a cycle period, four color data are sequentially displayed according to the color display sequence and the read frame data. The cycle period includes four field periods. The color data are displayed respectively during the field periods. In a first field period of the cycle period, a plurality of scan line pixels in a liquid crystal panel are sequentially scanned according to the frame data in the frame register. If the frame register has not updated the stored frame data with the scan line data, the timing controller continues scanning the scan line pixels in the liquid crystal panel according to the frame data.

The present invention further provides an LCD including a liquid crystal panel, a driving apparatus, and a backlight module. The driving apparatus is used to drive the liquid crystal panel and includes a line buffer, a frame register, and a timing controller. The line buffer is used to temporarily store a plurality of scan line data output from an image processor. The frame register is electrically connected to the line buffer and reads the scan line data through the line buffer to update a frame data stored in the frame register. The frame data includes three color data R, G, and B. The timing controller is electrically connected to the line buffer and the frame register to read the frame data in the frame register and to control the timing of the frame register updating the frame data.

The timing controller is further used to perform the following steps. A color display sequence is set to be RGBG, RGRB or RBGB. In a cycle period, four color data are sequentially displayed according to the color display sequence and the read frame data. The cycle period includes four field periods. The color data are displayed respectively during the field periods. In a first field period of the cycle period, a plurality of scan line pixels in a liquid crystal panel are sequentially scanned according to the frame data in the frame register. If the frame register has not updated the stored frame data with the scan line data, the timing controller continues scanning the scan line pixels in the liquid crystal panel according to the frame data.

The backlight module is used to provide backlight to the liquid crystal panel and is divided into a first sub region, a second sub region, and a third sub region according to a scan direction of the timing controller. In the first field period of the cycle period, displayed color lights in the first sub region, second sub region, and third sub region are sequentially updated according to a first color data corresponding to the first field period. When the first sub region is being updated, the second sub region is inserted with black. When the second sub region is being updated, the third sub region is inserted with black. When the third sub region is being updated, the first sub region is inserted with black.

The preset invention uses a specific color display sequence in connection with a specific backlight driving method to display images so color loss resulting from the display color turning from red to green, from green to blue, or from blue to red may be reduced, especially when displaying a still image or in a low temperature environment. In addition, in the present invention, images are displayed according to the color display sequence and the frame data stored in the frame buffer without care of whether the frame data has been updated (i.e. ignoring whether the original image data has been completely displayed on screen). Therefore, the technical means of the present invention may be integrated with the conventional FSC-LCD and only the driving timing of the timing controller needs to be adjusted.

In order to make the aforementioned features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

The First Embodiment

Figure 2:
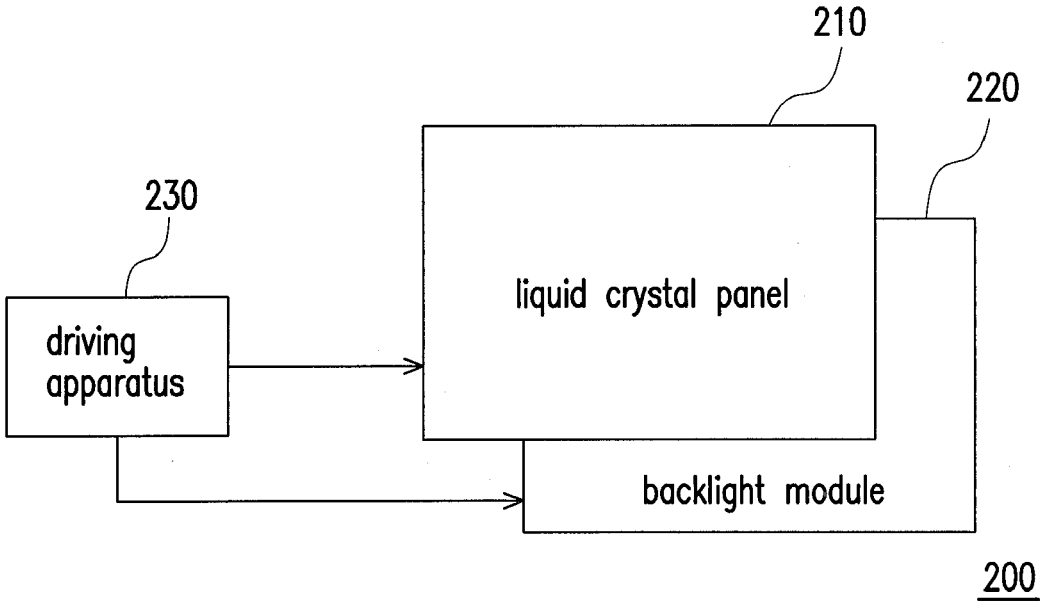
FIG. 2 illustrates an FSC-LCD device according to the first embodiment of the present invention.

FIG. 2 illustrates an FSC-LCD device according to the first embodiment of the present invention. An LCD 200 includes a liquid crystal panel 210, a backlight module 220, and a driving apparatus 230. The backlight module 220 is disposed behind the liquid crystal panel 210 and is used to provide backlight required by the backlight module 220. The driving apparatus 230 is used to drive pixels in the liquid crystal panel 210 to display images. The backlight module 220 emits, in association with the driving timing of the driving apparatus 230, a color light corresponding to the color display sequence.

In the present embodiment, the color display sequence of the liquid crystal panel 210 and the backlight module 220 is RGBG, wherein R, G and B represent the three primary colors of light (red, green and blue). Compared with color display sequence RGB of conventional technology, a field of G is inserted each time after three fields of RGB have been displayed in the present embodiment. The frame data stored in the frame register of the driving apparatus 230 is directly used for the color data of the G field without care of whether the frame data of the original image has been completely displayed on screen. In other words, the main concern of the frame display method in the present embodiment lies in the display sequence of the fields and ignores whether the frame data is valid. Therefore, it matters not whether the current read frame data is the current frame data to be displayed as long as the corresponding color data is the same. With the RGBG color display sequence, color loss resulted from the switching process of turning from red to green, from green to blue, and from blue to red may be reduced.

Figure 3A:
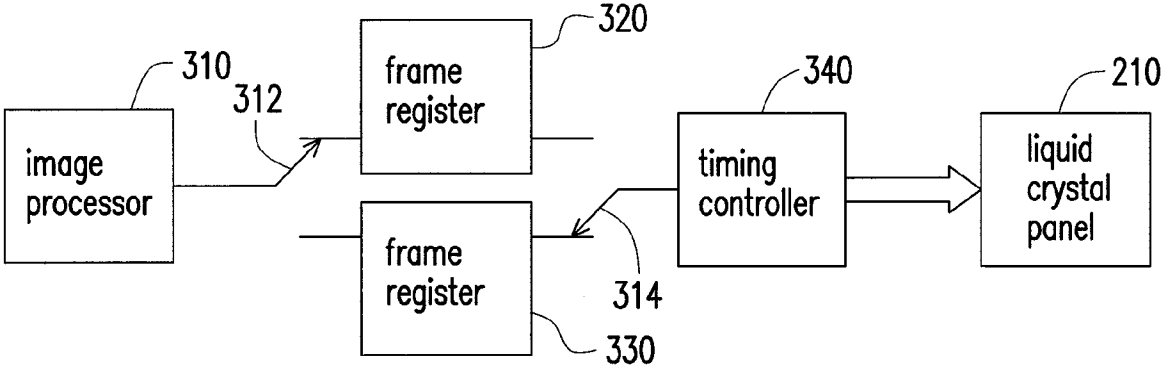
FIG. 3A is a circuit diagram of a driving apparatus 230 according to the first embodiment of the present invention.

Next, the driving apparatus 230 is further illustrated in the following. Referring to FIG. 3A, FIG. 3A is a circuit diagram of the driving apparatus 230 according to the first embodiment of the present invention. The driving apparatus 230 at least includes frame registers 320 and 330 and a timing controller 340. The driving apparatus 230 alternately stores, in the frame registers 320 and 330, image data, including a plurality of frame data each of which comprises a plurality of scan line data 9, and may be divided into three color data RGB, output from an image processor 310 so as to update the frame data in the frame registers 320 and 330. It should be noted that the frame registers 320 and 330 may respectively consist of two registers or may be two memory magnetic sectors in a same memory device as long as the frame registers 320 and 330 may respectively support read or write functions. Read or Write path of the frame registers 320 and 330 may be switched through switches 312 and 314. When the frame register 320 is storing the image data output from the image processor 310, the timing controller 340 reads the frame data in the frame register 330 through the switch 314 for display. Correspondingly, when the frame register 330 is storing the image data output from the image processor 310, the timing controller 340 reads the frame data in the frame register 320 through the switch 314 for display.

The timing controller 340 alternately reads the frame data in the frame registers 320 and 330 according to a frame period and displays the frame data on the liquid crystal panel 210, wherein each of the frame periods includes three field periods. The timing controller 340 sequentially displays four color data in a cycle period according to the RGBG color display sequence and the read frame data, wherein the cycle period includes four field periods. The color data are displayed respectively during the field periods. In other words, in the present embodiment, the frame data are alternately read by the duration of the frame period, but the color display sequence corresponding to the field period would be cycled by the sequence RGBG.

Figure 3B:
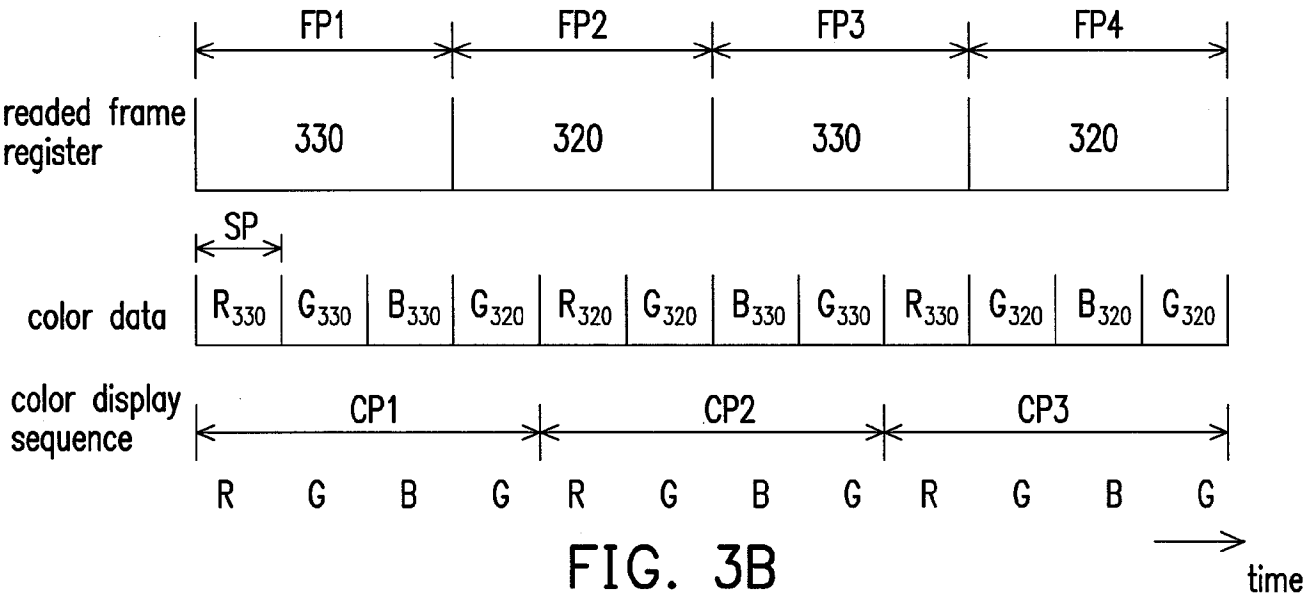
FIG. 3B is a display timing schematic diagram according to the first embodiment of the present invention.

Referring to FIG. 3B, FIG. 3B is a display timing schematic diagram according to the present embodiment. The timing controller 340 alternately reads the frame data in the frame registers 320 and 330 according to the frame periods FP1~FP4. Each of the frame periods FP1~FP4 includes three field periods SP. Each of the cycle periods CP1~CP3 includes four field periods SP to sequentially display the four color data RGBG. Therefore, the length of each cycle periods CP1~CP3 and the length of each frame periods FP1~FP4 are not consistent. The timing controller 340 reads from the frame register 330 during the frame period FP1 so the color data $R_{330}$, $G_{330}$, and $B_{330}$ from the frame register 330 are displayed in the first three field periods of the cycle period CP1. In the fourth field period of the cycle period CP1, the color data $G_{330}$ from the frame register 320 is displayed.

Afterward, when entering the next cycle period CP2, images are also displayed according to the color display sequence RGBG. However, the color data are respectively read from the frame register 320 (the color data $R_{320}$ and $G_{320}$) and the frame register 330 (the color data $B_{330}$ and $G_{330}$). Although the color data $B_{320}$ corresponding to B in the frame register 320 is not displayed during the frame period FP2, the read and write path is still switched to the frame register 330 when entering the frame period FP3. Display is performed according to the frame data in the frame register 330 and the color data $B_{320}$ that is not displayed in the previous frame period FP2 is ignored. Following procedures may be deduced similarly and are not to be iterated hereby.

From the above illustration, data update in the frame registers 320 and 330 and the read timing may be performed according to timing in conventional technology. The timing controller 340 uses the color display sequence RGBG to display images. The timing controller 340 only considers about the color display sequence and not about whether the color data correspond to a same frame period or come from a same frame register 320 or 330. The color data that is not displayed is directly ignored.

In addition, it should be noted that the color display sequence set by the timing controller 340 is not limited to RGBG and may also be RGRB or RBGB. In the case of RGBG, R and B are both surrounded by G to avoid a situation of turning from B to R. In the case of RGRB, G and B are both surrounded by R to avoid a situation of turning from G to B. In the case of RBGB, R and G are both surrounded by B to avoid a situation of turning from R to G. Hence, the aforementioned color switching sequences all have the effect of reducing color loss. Persons of ordinary skill in the art should be able to deduce implementation details in the cases of RGRB and RBGB from the above illustrated embodiment, which will not be further described herein.

Figure 4:
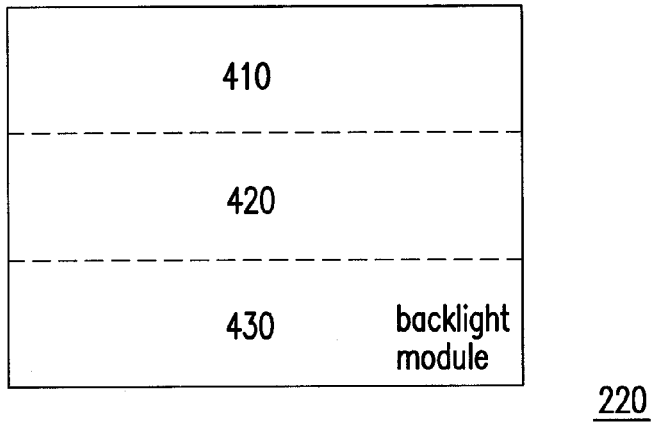
FIG. 4 is a schematic diagram illustrating regions of a backlight module 220 according to the first embodiment of the present invention.

The driving method of the backlight module 220 of the present embodiment is further illustrated in the following section. Referring to FIG. 4, FIG. 4 is a schematic diagram illustrating regions of the backlight module 220 according to the present embodiment. The backlight module 220 is divided into a first sub region 410, a second sub region 420, and a third sub region 430 according to a scan direction (e.g. from top to bottom) of the driving apparatus 230. The backlight module 220 sequentially updates the first sub region 410, the second sub region 420, and the third sub region 430 according to the corresponding color data in each field period.

Take the first field period SP in the cycle period CP1 as an example, the corresponding color data is $R_{320}$ (i.e. red). Thus, red color light is sequentially displayed in the first sub region 410, the second sub region 420, and the third sub region 430 in association with the timing and region of the timing controller 340 scanning the liquid crystal panel 210. In addition, to avoid the problem of light intermixing between adjacent sub regions, black insertion (turning off backlight) is performed in the next sub region of the sub region being updated. Thus, when the color light of the first sub region 410 is being updated, the second sub region 420 is inserted with black. When the color light of the second sub region 420 is being updated, the third sub region 430 is inserted with black. When the color light of the third sub region 430 is being updated, the first sub region 410 is inserted with black. The backlight module 220 completes three update processes in each field period SP, i.e. sequentially updating the color lights of the first sub region 410, the second sub region 420, and the third sub region 430.

Figure 5:
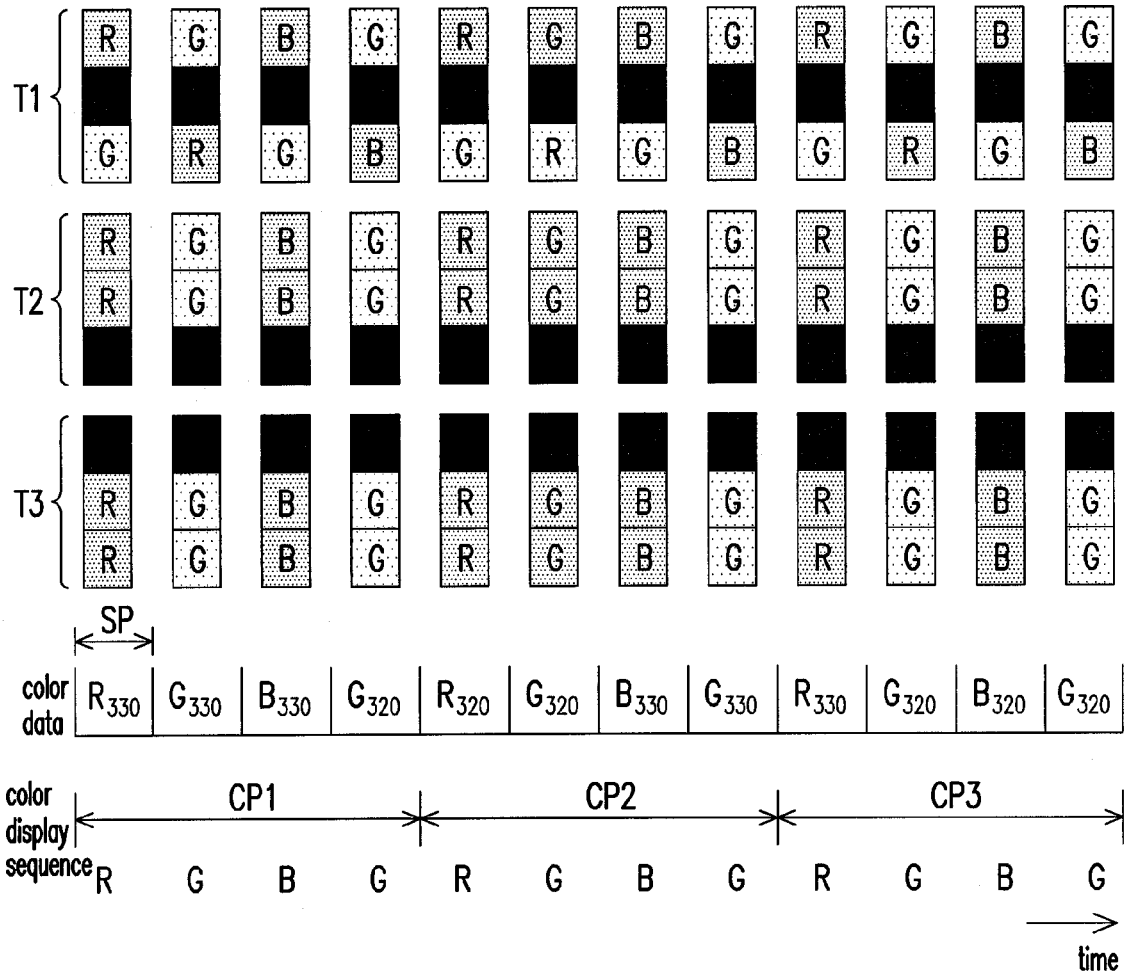
FIG. 5 is a schematic diagram illustrating update of color light of the backlight module 220 according to the first embodiment of the present invention.

Referring to FIG. 5, FIG. 5 is a schematic diagram illustrating update of color light of the backlight module 220 according to the present embodiment. Taking the first field period SP of the cycle period CP1 as an example, the color light of the first sub region 410 is updated during the first duration T1 which is the former ⅓ of the field period SP. The first sub region 410 displays the corresponding red color light and the second sub region 420 is inserted with black. The color light of the second sub region 420 is updated during the second duration T2 which is the middle ⅓ of the field period SP. The second sub region 420 displays the corresponding red color light and the third sub region 430 is inserted with black. The color light of the third sub region 430 is updated during the third duration T3 which is the latter ⅓ of the field period SP. The third sub region 430 displays the corresponding red color light and the first sub region 410 is inserted with black.

When entering the second field period of the cycle period CP1, the green color light is used to update the first sub region 410, the second sub region 420, and the third sub region 430 sequentially. In different field periods, the main difference is the color light used to update the sub regions. The remaining flow of operation is similar to the abovementioned, which will not be further described herein.

The Second Embodiment

Figure 6:
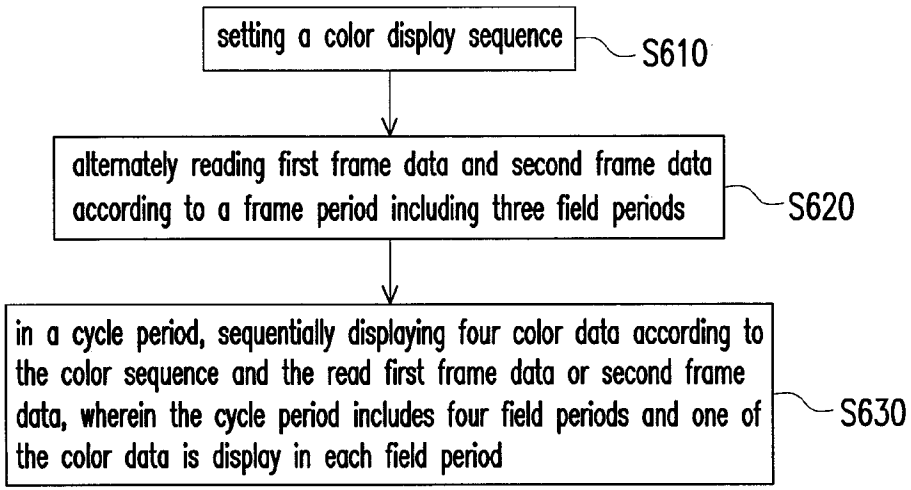
FIG. 6 is a flow chart illustrating a display method according to the second embodiment of the present invention.

From the above illustration of the first embodiment, a display method of an LCD is summarized. Referring to both FIG. 5 and FIG. 6, FIG. 6 is a flow chart illustrating a display method according to the second embodiment of the present invention. The present display method is suitable for the driving apparatus 230 and the backlight module 220 of the LCD in FIG. 2. The driving apparatus 230 sequentially updates the frame data stored in the frame registers 320 and 330 (respectively referred to as a first frame data and a second frame data). Each frame data includes three color data R, G, and B. The backlight module 220 is divided into a first sub region, a second sub region, and a third sub region according to a scan direction of the driving apparatus 230.

First, a color display sequence is set (step S610). Then, the frame data in the frame registers 320 ad 330 are alternately read according to a frame period. The frame period similarly includes three field periods to correspondingly display three color data (step S620). Next, in a cycle period, four color data are sequentially displayed according to the color display sequence and the read first frame data or second frame data. The cycle period includes four field periods. The color data are displayed respectively during the field periods (step S630). The color display sequence is RGBG, RGRB or RBGB.

It should be noted that in the step S630, whether the read data is the first frame data or the second frame data depends on the frame period. Namely, the first frame data and the second frame data are alternately switched to be read out every time a frame period passes. The color data required for display comes from the currently read frame register 320 or 330 and is not limited to the first frame data or the second frame data. In other words, in the present embodiment, when reading the frame data, a switch is made according to the frame period. Color switches are made according to the cycle period during display. Each cycle period does not necessarily correspond to a complete image. During display, the frame data that can be currently read is used directly for display. What matters is the color display sequence and not whether the frame corresponding to the color data is the same.

In addition, the step S630 further includes backlight control. In the first field period of the cycle period, the color light of the first sub region, second sub region, and third sub region is sequentially updated according to the corresponding color data in the first field period. When the first sub region is being updated, the second sub region is inserted with black. When the second sub region is being updated, the third sub region is inserted with black. When the third sub region is being updated, the first sub region is inserted with black. Please refer to the above illustrations of FIG. 4 and FIG. 5 for implementation details of backlight control. Please refer to the illustration of the first embodiment for remaining operation details of the present embodiment, which will not be further described herein.

Third Embodiment

Figure 7:
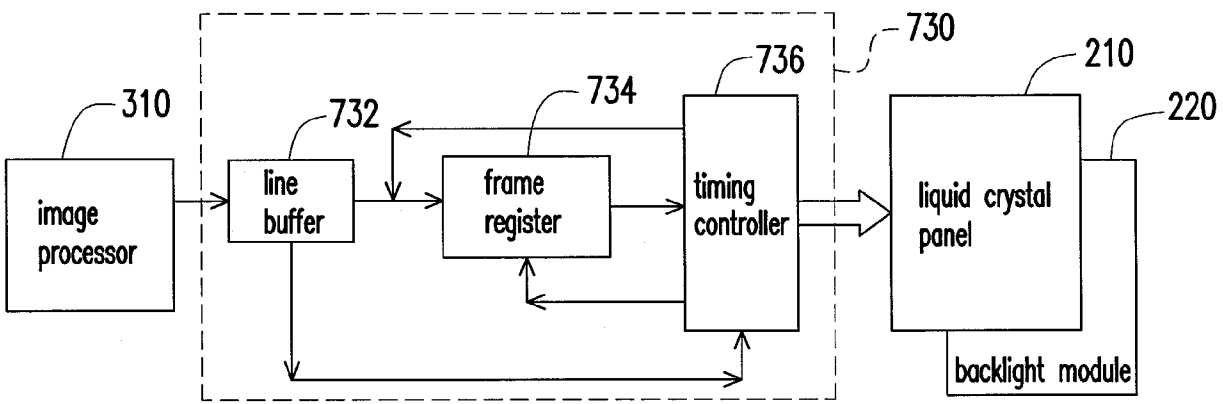
FIG. 7 is a circuit diagram of a driving apparatus according to the third embodiment of the present invention.

In combination with the abovementioned display method, the present invention further provides a driving apparatus, wherein the number of frame registers may be reduced. Referring to FIG. 7, FIG. 7 is a circuit diagram of a driving apparatus according to the third embodiment of the present invention. A driving apparatus 730 is electrically connected between an image processor 310 and a liquid crystal panel 210. The driving apparatus 730 includes a line buffer 732, a frame register 734, and a timing controller 736. The frame register 734 is electrically connected between the line buffer 732 and the timing controller 736. The timing controller 736 is further electrically connected to the line buffer 732 to control the frame register 734 through the timing that the line buffer 732 updates the frame data.

In the present embodiment, a frame rate of the timing controller 736 is not an integral multiple of an output frame data rate of the image processor 310. Therefore, the timing controller 736 and the image processor 310 do not access the frame data in the frame register 734 in a synchronized manner. The timing controller 736 outputs the frame data to the liquid crystal panel 210 for display at a higher rate. While the timing controller 736 is reading from the frame register 734, the frame data output from the image processor 310 is stored in the line buffer 732 (depending on the length of time, there may only be pixel data of a few scan lines, briefly referred to as scan line data). When the timing controller 736 stops reading from the frame register 734, the frame register 734 then reads the scan line data in the line buffer 732 to update the frame data in the frame register 734.

If the bandwidth of the frame register 734 is large enough, updating the required frame data may be finished within the interval when the timing controller 736 stops reading from the frame register 734. If the bandwidth of the frame register 734 is not large enough or the updating time is inadequate, the timing controller 736 still display images according to old frame data and does not wait for the frame register 734 to finish updating. Similarly, the data in the line buffer 310 is updated at the output rate of the image processor 310 without consideration on whether the frame register 734 has been read.

In other words, in the present embodiment, the timing controller 736 drives the liquid crystal panel 210 at its own frame rate while the image processor 310 outputs frame data at its own data output rate, without interfering with each other. If the data in the frame register 734 has been updated, the timing controller 736 displays the new frame data. If the data in the frame register 734 has not been updated, the timing controller 736 displays old frame data. Therefore, in an entire image, the pixel data of part of the scan lines may be displayed according to the data of a previous image. The ratio of the image displayed according to old data depends on the bandwidth of the frame register 734 and the time that the frame register 734 may be updated. In addition, it should be noted that when the image is a still image, the display quality of the present invention is not affected.

The timing that the timing controller 736 drives the liquid crystal panel 210 and the color display sequence are as described in the above first embodiment and second embodiment and the color display sequence is RGBG, RGRB or RBGB, for example. The main differences between the present embodiment and the above first embodiment lie in the circuit structures of the frame register 734 and the line buffer 732 and the method of data access thereof. In addition, the operating frequency of the timing controller 736 is also different. For example, the frame rate is greater than 60 Hz (i.e. field period rate of 180 Hz). In terms of color display sequence, the timing controller 736 similarly uses the color display sequence RGBG, RGRB or RBGB to update the liquid crystal panel 210. However, the displayed scan line data may be data of a current image or data of a previous image in an individual frame.

In other words, the present embodiment uses a line buffer 732 and a frame register 734 to replace the two frame registers 320 and 330 in FIG. 3A to save the number of frame registers. The remaining operating details of the timing controller 736 are as described in the illustration on the timing controller 340 in the first embodiment and in the display method in the second embodiment. The timing controller 736 in the present embodiment drives the liquid crystal panel 210 according to the display method in the second embodiment. The remaining operating details are not further described herein. Please refer to the illustration on FIG. 5 for the remaining operation details of the backlight module 220, which is not further described herein.

Figure 1:
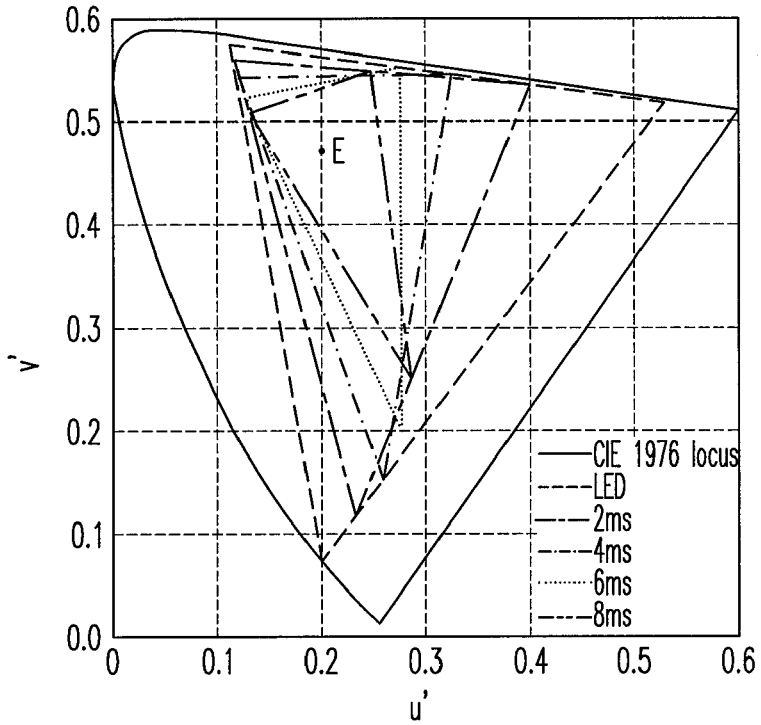
FIG. 1 (PRIOR ART)
FIG. 1 illustrates a chromaticity curve range under different reaction speeds of liquid crystals.
Figure 8:
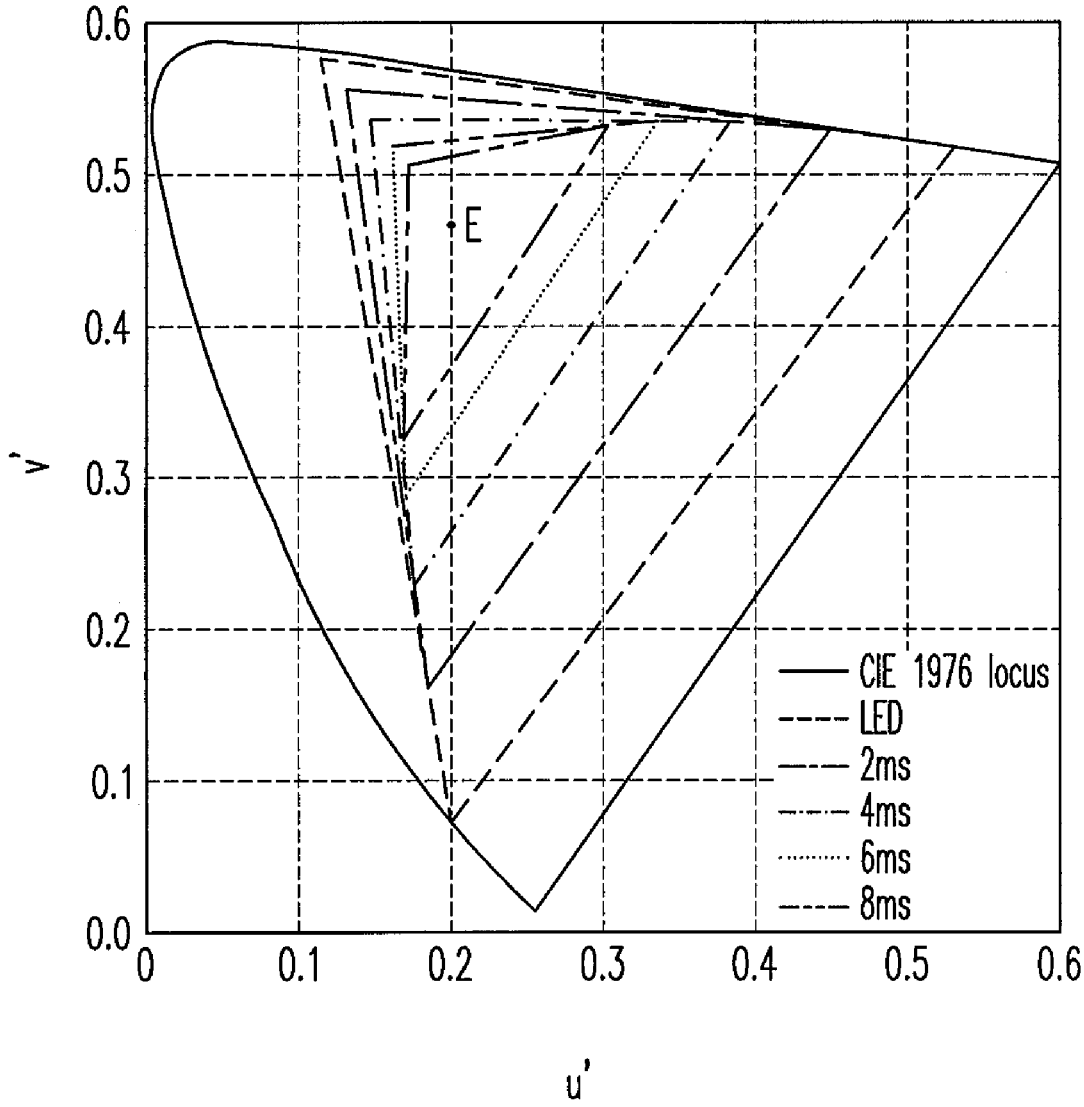
FIG. 8 illustrates a chromaticity curve range according to the embodiments of the present invention.

FIG. 8 illustrates a chromaticity curve range according to the above embodiments of the present invention. It can be found, by comparing FIG. 1 and FIG. 8, that the chromaticity curve range of the above embodiments is more linear with a lower degree of color loss.

Furthermore, it should be noted that the above embodiments may be incorporated with conventional driving methods, wherein the driving methods of the above embodiments may be used when displaying a still image, while a conventional driving method may be switched to when displaying dynamic images so as to increase the display quality of dynamic images.

In summary, the present invention uses the color display sequence RGBG, RGRB or RBGB to update the liquid crystal panel and thus may improve the problem of color loss of the FSC-LCD due to a low transition speed of liquid crystals in a low temperature environment. At the same time, the present invention further provides a data access method particularly directed at displaying still images to reduce the required number of frame registers and thus save manufacturing costs. Furthermore, the present invention is especially suitable for improving display quality in a low temperature environment and reduces color loss of images due to a low transition speed of liquid crystals.

It will be apparent to those of ordinary skills in the technical field that various modifications and variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. A display method, suitable for a driving apparatus and a backlight module of a liquid crystal display, wherein the driving apparatus sequentially updates a first frame data stored in a first frame register and a second frame data stored in a second frame register, each of the frame data comprises three color data R, G, and B, the backlight module is divided into a first sub region, a second sub region, and a third sub region according to a scan direction of the driving apparatus, and the display method comprises:

setting a color display sequence;

alternately reading the first frame data and the second frame data according to a frame period comprising three field periods; and in a cycle period, sequentially displaying four color data according to the color display sequence and the read first frame data or second frame data, wherein the cycle period comprises four field periods and the color data are displayed respectively during the field periods;

wherein the color display sequence is RGBG, RGRB or RBGB.

2. The display method according to claim 1, wherein the step of sequentially displaying four color data according to the color display sequence and the read first frame data or second frame data further comprises:

in a first field period of the cycle period, sequentially updating color lights displayed in the first sub region, the second sub region, and the third sub region according to a first color data corresponding to the first field period, wherein when the first sub region is being updated, the second sub region is inserted with black, when the second sub region is being updated, the third sub region is inserted with black, and when the third sub region is being updated, the first sub region is inserted with black.

3. The display method according to claim 2, wherein the step of sequentially displaying four color data according to the color display sequence and the read first frame data or second frame data further comprises:

in a second field period of the cycle period, sequentially updating color lights displayed in the first sub region, the second sub region, and the third sub region according to a second color data corresponding to the second field period, wherein when the first sub region is being updated, the second sub region is inserted with black, when the second sub region is being updated, the third sub region is inserted with black, and when the third sub region is being updated, the first sub region is inserted with black.

4. The display method according to claim 2, wherein the second sub region is between the first sub region and the third sub region.

5. The display method according to claim 2, wherein the first color data is R, G, or B.

6. A liquid crystal display (LCD), comprising:

a liquid crystal panel; and a driving apparatus, used to drive the liquid crystal panel and sequentially updating a first frame data stored in a first frame register and a second frame data stored in a second frame register, wherein each of the frame data comprises three color data R, G, and B and the driving apparatus is further used to execute the following steps:

setting a color display sequence;

alternately reading the first frame data and the second frame data according to a frame period comprising three field periods;

in a cycle period, sequentially displaying four color data according to the color display sequence and the read first frame data or second frame data, wherein the cycle period comprises four field periods and the color data are displayed respectively during the field periods; and a backlight module, used to provide a backlight to the liquid crystal panel, further divided into a first sub region, a second sub region, and a third sub region according to a scan direction of the driving apparatus, and in a first field period of the cycle period, sequentially updating displayed color lights in the first sub region, the second sub region, and the third sub region according to a first color data corresponding to the first field period, wherein when the first sub region is being updated, the second sub region is inserted with black, when the second sub region is being updated, the third sub region is inserted with black, and when the third sub region is being updated, the first sub region is inserted with black;

wherein the color display sequence is RGBG, RGRB or RBGB.

7. The LCD according to claim 6, wherein the second sub region is between the first sub region and the third sub region.

8. The LCD according to claim 6, wherein the first color data is R, G, or B.

9. A driving apparatus, used in a liquid crystal display, comprising:

a line buffer, used to temporarily store a plurality of scan line data output from an image processor;

a frame register, electrically connected to the line buffer and reading the scan line data through the line buffer to update a frame data stored in the frame register, wherein the frame data comprises three color data R, G and B; and a timing controller, electrically connected to the line buffer and the frame register to read the frame data in the frame register and to control the timing of the frame register updating the frame data;

wherein the timing controller is used to execute the following steps:

setting a color display sequence, the color display sequence being RGBG, RGRB or RBGB;

in a cycle period, sequentially displaying four color data according to the color display sequence and the read first frame data or second frame data, wherein the cycle period comprises four field periods and the color data are displayed respectively during the field periods; and in a first field period of the cycle period, sequentially scanning a plurality of scan line pixels in a liquid crystal panel according to the frame data in the frame register;

wherein if the frame register has not updated the stored frame data with the scan line data, the timing controller continues scanning the scan line pixels in the liquid crystal panel according to the frame data.

10. A liquid crystal display (LCD), comprising:

a liquid crystal panel; and a driving apparatus, used to drive the liquid crystal panel, comprising:

a line buffer, used to temporarily store a plurality of scan line data output from an image processor;

a frame register, electrically connected to the line buffer and reading the scan line data through the line buffer to update a frame data stored in the frame register, wherein the frame data comprises three color data R, G and B; and a timing controller, electrically connected to the line buffer and the frame register to read the frame data in the frame register and to control the timing of the frame register updating the frame data;

wherein the timing controller is used to execute the following steps:

setting a color display sequence, the color display sequence being RGBG, RGRB or RBGB;

in a cycle period, sequentially displaying four color data according to the color display sequence and the read frame data, wherein the cycle period comprises four field periods and the color data are displayed respectively in each field period; and in a first field period of the cycle period, sequentially scanning a plurality of scan line pixels in the liquid crystal panel according to the frame data in the frame register, wherein if the frame register has not updated the stored frame data with the scan line data, the timing controller continues scanning the scan line pixels in the liquid crystal panel according to the frame data; and a backlight module, used to provide a backlight to the liquid crystal panel, further divided into a first sub region, a second sub region, and a third sub region according to a scan direction of the timing controller, and in the first field period of the cycle period, sequentially updating displayed color lights in the first sub region, the second sub region, and the third sub region according to a first color data corresponding to the first field period, wherein when the first sub region is being updated, the second sub region is inserted with black, when the second sub region is being updated, the third sub region is inserted with black, and when the third sub region is being updated, the first sub region is inserted with black.

11. The LCD according to claim 10, wherein the second sub region is between the first sub region and the third sub region.

12. The LCD according to claim 10, wherein the first color data is R, G or B.

* * * * *